US007080977B2

(12) United States Patent
McCormick et al.

(10) Patent No.: US 7,080,977 B2
(45) Date of Patent: Jul. 25, 2006

(54) DISCHARGE DIFFUSER FOR SCREW COMPRESSOR

(75) Inventors: Duane C. McCormick, Colchester, CT (US); Jeffrey A. Math, Wallingford, CT (US); Dochul Choi, Lexington, MA (US); Gavin J. Hendricks, Manchester, CT (US); William H. Rousseau, Savannah, GA (US); H. Ezzat Khalifa, Manlius, NY (US); Jeffery J. Nieter, Coventry, CT (US); Timothy C. Wagner, East Hartford, CT (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 10/397,018

(22) Filed: Mar. 25, 2003

(65) Prior Publication Data

US 2004/0191102 A1 Sep. 30, 2004

(51) Int. Cl.
*F01C 1/16* (2006.01)
*F03C 2/00* (2006.01)

(52) U.S. Cl. ..... 418/201.1; 415/207; 415/211.2

(58) Field of Classification Search ..... 418/201.1, 418/181; 415/204, 206, 207, 211.2
See application file for complete search history.

(56) References Cited

U.S. PATENT DOCUMENTS

| | | | | |
|---|---|---|---|---|
| 2,474,653 | A * | 6/1949 | Boestad | 418/201.1 |
| 4,182,595 | A * | 1/1980 | Burney et al. | 415/204 |
| 4,934,450 | A * | 6/1990 | Dice et al. | 166/75.11 |
| 6,638,043 | B1 * | 10/2003 | Khalifa | 418/201.1 |
| 6,672,856 | B1 * | 1/2004 | Khalifa et al. | 418/201.1 |

FOREIGN PATENT DOCUMENTS

JP 04175488 A * 6/1992

* cited by examiner

*Primary Examiner*—Theresa Trieu

(57) ABSTRACT

A discharge collector and diffuser for a screw compressor, including a housing having an inlet for receiving flow from a compressor and an outlet and defining therebetween a collector portion, a transition portion and a diffuser portion, the collector portion being adapted to receive a plurality of non-parallel streams from a compressor and to guide the streams into a substantially parallel flow direction, the housing further having a splitter plate positioned in the collector portion to separate the non-parallel streams from each other, whereby the streams are maintained separate until they are substantially parallel, thereby reducing flow losses.

5 Claims, 1 Drawing Sheet

DISCHARGE DIFFUSER FOR SCREW COMPRESSOR

BACKGROUND OF THE INVENTION

The invention relates to a discharge diffuser for screw compressors.

Screw compressor efficiency is known to fall off significantly for tip speeds above 50 m/s. Much of this loss in efficiency is due to the dissipation of kinetic energy, or dynamic head, at the discharge port into turbulence.

Traditionally, the response to this problem has been to limit the maximum design tip speeds for screw compressors. This limitation results in larger rotor diameters which in turn increase cost and size of such devices.

It is clear that the need remains for an effective solution to this problem.

It is therefore the primary object of the present invention to provide for recovering a substantial fraction of the discharge dynamic head so as to allow for cost and size reduction, as well as a greater tonnage range for a given compressor size.

Other objects and advantages will appear hereinbelow.

SUMMARY OF THE INVENTION

In accordance with the present invention, the foregoing objects and advantages have been readily attained.

According to the invention, a discharge collector and diffuser for a screw compressor is provided, which comprises a housing having an inlet for receiving flow from a compressor discharge and an outlet and defining therebetween a collector portion and a diffuser portion, said collector portion being adapted to receive a plurality of non-parallel and unsteady streams from a compressor discharge, said streams having a flow profile, and said collector portion being shaped to match said flow profile and to guide said streams into a substantially parallel flow direction.

BRIEF DESCRIPTION OF THE DRAWINGS

A detailed description of preferred embodiments of the present invention follows, with reference to the attached drawings, wherein.

DETAILED DESCRIPTION

The invention relates to a discharge collector and diffuser for a screw compressor and, more particularly, to a discharge collector which follows the flow profile of streams exiting a compressor, which flow profile includes a plurality of different flow directions, and guides the exiting streams into a substantially parallel direction followed by diffusing such streams so as to reduce turbulence and thereby recover dynamic head as desired.

Conventional screw compressors have discharge housings that impose on the discharge port, that is, the region immediately downstream of the compressor, a cross-sectional flow area which is as large as possible. The reasoning behind this approach is to avoid restricting the flow in any way as it is pushed out of the screw lobes of the compressor. In accordance with the present invention, and contrary to conventional approaches, the cross-sectional area of the collector portion follows the flow profile emanating from the discharge port, which has been found to contract for a distance along the discharge path. The collector portion therefore preferably necks down to follow this natural contraction in flow.

By following the natural contraction in flow, there is no increase in flow restriction of the discharge port and, yet, the structure prevents strong free shear layers from rolling up and generating turbulence which is a primary flow loss mechanism. Once the flow has completed the expected natural contraction, it can be diffused and pressure recovered without conventional losses due to turbulence.

The flow to be received by the collector portion in accordance with the present invention can have a flow profile or plurality of non-parallel streams as identified above, and can also periodically be unsteady, and in this regard the collector portion further serves to collect these unsteady streams and generate a more steady flow which further serves to reduce turbulence as desired.

Figure 1:
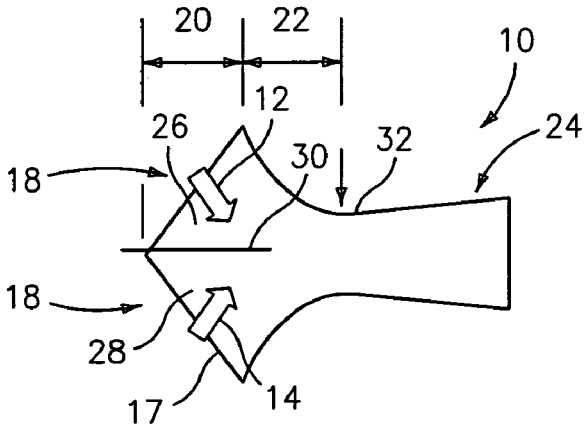
FIG. 1 is a top schematic view of a discharge collector and diffuser in accordance with the present invention.
Figure 2:
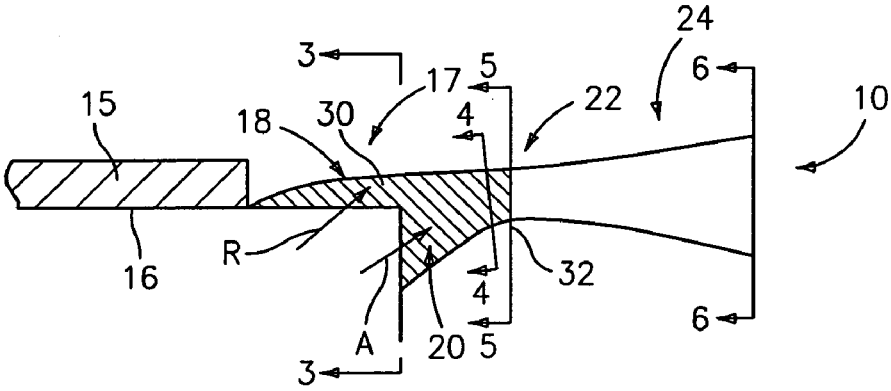
FIG. 2 is a side schematic view of the discharge collector and diffuser of FIG. 1 rotated 90° and positioned on a compressor housing.

FIGS. 1 and 2 schematically illustrate a collector and diffuser 10 in accordance with the present invention, which is advantageously associated with a compressor to receive and treat the discharge streams from the compressor as desired.

Collector/diffuser 10 in accordance with the invention is shown receiving a flow from at least two rotors, in this case a flow 12 from a female rotor and a flow 14 from a male rotor, and a portion of a compressor housing 15 and rotor tips at their cusp 16 are schematically illustrated in FIG. 2.

Collector/diffuser 10 in accordance with the present invention has a housing 17 defining an inlet portion 18 adapted for receiving the separate and non-parallel streams discharged from the compressor, a collector portion 20 downstream of inlet portion 18 which is adapted to follow the flow profile exiting the compressor and to guide the separate non-parallel streams into a substantially parallel direction and a diffuser portion 24 having an increasing cross sectional area in the flow direction which serves to convert a portion of kinetic energy preserved by guiding of the streams through inlet portion 18 and collector portion 20 into pressure as desired. Diffuser portion 24 leads to an outlet as shown.

In accordance with the invention, experiments and computerized fluid dynamics (or CFD) indicate that compressed refrigerant vapor (or gas) discharged from rotors of a screw compressor has a particular averaged flow profile. Specifically, it has been found that such flows at the discharge port typically have a contracting flow profile, and in accordance with the present invention, collector portion 20 is adapted to follow the contours of this flow profile so as to avoid turbulence while flows from the screws of the compressor are guided to a substantially parallel direction. Following collector portion 20, flow is then passed to the diffuser portion 24 where the different streams are now substantially parallel and have finished contracting, and can be diffused as desired with minimal turbulent losses.

By adapting inlet portion 18 and collector portion 20 to match the flow profile of discharge from the rotors, turbulent losses in this portion of the flow path can advantageously be minimized.

In accordance with one aspect of the present invention, a transition portion 22 may be provided and positioned between collector portion 20 and diffuser portion 24. If desired, transition portion 22 can be provided having a cross-sectional shape which transitions from the shape of collector portion 20 to a different shape, if desired, depending upon particular flow characteristics.

In accordance with the present invention; collector/diffuser 10 is positioned relative to a compressor such that inlet portion 18 receives flow from the so-called "radial" and "axial" ports. In this regard, housing 17 defining inlet portion 18 is preferably provided as a shroud for communicating with and receiving discharge flow from a V-shaped radial discharge port in the rotor housing, which is a common and well known structure, and also for receiving flow from the axial discharge port which has significant flow components in axial and azimuthal directions.

Collector portion 20, and inlet portion 18 as well, may be divided into two sections 26, 28 by a splitter plate 30 positioned therebetween so as to maintain the non-parallel streams received from the compressor separate from each other until they are guided into a substantially parallel direction. Thus, as illustrated in FIGS. 1 and 2 splitter plate 30 may advantageously be positioned through inlet portion 18 and collector portion 20 and extending to a point where streams received from the compressor have been guided to a substantially parallel direction.

In further accordance with the present invention, it has been found that the sizing of the diffuser throat area 32 can be important since under-sizing will result in increased dynamic head, and over-sizing can result in stalling of flow in the diffuser.

In accordance with the present invention, it has been found that the throat area ($A_T$) can be determined as follows:

$$A_T = m/\rho_2 U,$$

wherein m is the mass flow rate, $\rho_2$ is the discharge density, and U is the average magnitude of the discharge velocity.

Mass flow rate and density of the fluids are known. However, the discharge velocity, U, is not well understood. It has been found, however, that a reasonable estimate for discharge velocity, which includes velocity components due to chamber deformation, pressure differences, and chamber rotation, gives U, or average discharge velocity, substantially equal to the tangential velocity of the rotor tips.

It is noted that the embodiment illustrated in FIGS. 1 and 2 extends generally in the axial direction. This is preferred since positioning of collector portion 20 and diffuser portion 24 in a substantially straight line along the natural discharge flow direction, a substantial portion of which is axial, helps avoid flow losses. This flow direction, and therefore the orientation of collector portion 20, is desirably positioned so as to allow diffusion prior to any turning of the flow, thereby further minimizing any losses in dynamic head.

In the embodiment of FIG. 2, housing 17 defining inlet portion 18 is formed as a shroud adapted to communicate with axial and radial porting of the compressor and to receive flows from both ports of the compressor. Flow emanating from each port has all flow directions (axial A, radial R, and azimuthal) and collector portion 20 advantageously serves to direct these flows into a substantially parallel direction while separator plate 30 (if used) keeps them separate so as to avoid interference between same. Once the flows are substantially parallel, they flow past separator plate 30 (again, if used) and through transition portion 22 (if used) and diffuser portion 24 as desired.

Figure 3:
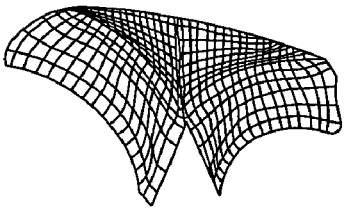
FIG. 3 is a schematic cross-sectional view taken along lines 3—3 of FIG. 2.

FIG. 3 is a cross-section showing flow area as defined by collector portion 20 and the discharge port of the housing. At this point, in order to match the port shape, the flow area is preferably defined having a shape as shown.

Figure 4:
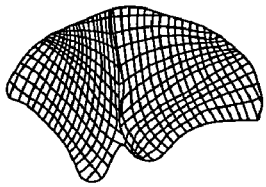
FIG. 4 is a schematic cross-sectional view taken along lines 4—4 of FIG. 2.

FIG. 4 shows the flow area of collector portion 20 along the lines 4—4 of FIG. 2, and shows the flow profile matching an expected contracting flow profile.

Figure 5:
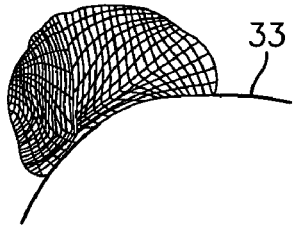
FIG. 5 is a schematic cross-sectional view taken along lines 5—5 of FIG. 2.

FIG. 5 shows the flow area corresponding to the throat area 32 of the discharge collector and diffuser 10 of the present invention, and shows a portion 33 of a bearing housing to which discharge collector and diffuser 10 can be mounted or otherwise positioned against for support.

Figure 6:
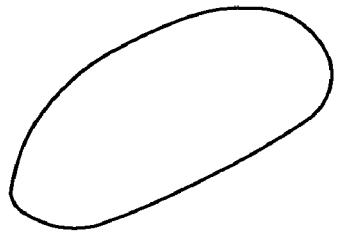
FIG. 6 is a schematic cross-sectional view taken along lines 6—6 of FIG. 2.

Finally, FIG. 6 shows the flow profile or area at an outlet end of discharge collector and diffuser 10 according to the invention. The profiles of FIGS. 5 and 6, it should be noted, could be round if desired. The shapes illustrated, however, are preferred since they are selected to maintain the expected flow profile and thereby avoid flow losses. Further, this shape is well suited to existing materials from which collector/diffuser 10 is made, and the shape is also well suited to fit within the plenum housing located downstream of the bearing housing.

Collector portion 20 following the flow profile of the discharged streams from the compressor serves to preserve kinetic energy of the stream exiting the compressor through to the diffuser and further serves to allow for conversion of a substantial portion of this kinetic energy into pressure, thereby providing for more efficient operation of the compressor as desired in accordance with the present invention.

In accordance with a further embodiment of the present invention, turning vanes may be incorporated into inlet portion 18 so as to provide for a more efficient guiding of flow from non-parallel to parallel directions.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

The invention claimed is:

1. A discharge collector and diffuser for a screw compressor, comprising:

a housing having an inlet for receiving flow from a compressor and an outlet and defining therebetween a collector portion and a diffuser portion, said collector portion receiving a plurality of non-parallel streams from a compressor, said streams having a flow profile, and said collector portion being shaped to match said flow profile and to guide said streams into a substantially parallel flow direction, wherein a diffuser throat is defined between said collector portion and said diffuser portion, wherein said throat has a throat area ($A_T$) defined as follows:

$A_T = m/\rho_2 U$, wherein m=mass flow rate, $\rho_2$=discharge density, and

U=average discharge velocity.

2. The apparatus of claim 1, wherein said diffuser portion has a flow area which increases in a flow direction.

3. The apparatus of claim 1, wherein said housing has a shroud portion adapted to communicate with both axial and radial discharge porting of said compressor.

4. The apparatus of claim 1, wherein the diffuser portion is downstream of the collector portion and increases in flow area from the collector portion to the outlet.

5. A discharge collector and diffuser for a screw compressor, comprising:

a housing having an inlet for receiving flow from a compressor and an outlet and defining therebetween a collector portion and a diffuser portion, said collector portion receiving a plurality of non-parallel streams from a compressor, said streams having a flow profile, and said collector portion being shaped to match said flow profile and to guide said streams into a substantially parallel flow direction, further comprising a splitter plate positioned in said collector portion to separate said non-parallel streams from each other, whereby said streams are maintained separate until they are substantially parallel, thereby reducing turbulence.

* * * * *